US008814231B2

(12) United States Patent
Gandhi

(10) Patent No.: US 8,814,231 B2
(45) Date of Patent: Aug. 26, 2014

(54) ADAPTIVE DOOR HANDLES

(75) Inventor: Umesh N. Gandhi, Farmington Hills, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 1154 days.

(21) Appl. No.: 12/405,537

(22) Filed: Mar. 17, 2009

(65) Prior Publication Data

US 2010/0237634 A1 Sep. 23, 2010

(51) Int. Cl.
*E05B 3/00* (2006.01)

(52) U.S. Cl.
USPC ..... 292/336.3; 292/DIG. 22

(58) Field of Classification Search
USPC ..... 292/336.3, DIG. 22
See application file for complete search history.

(56) References Cited

U.S. PATENT DOCUMENTS

| | | | | |
|---|---|---|---|---|
| 5,865,481 | A | 2/1999 | Buschmann | |
| 6,042,159 | A | 3/2000 | Spitzley et al. | |
| 6,241,294 | B1 * | 6/2001 | Young et al. | 292/336.3 |
| 6,407,660 | B1 | 6/2002 | Bomya | |
| 6,565,134 | B1 | 5/2003 | Stuart et al. | |
| 6,586,926 | B1 | 7/2003 | Bomya | |
| 7,029,042 | B2 | 4/2006 | Belchine, III | |
| 7,190,161 | B2 | 3/2007 | Bomya | |
| 7,201,405 | B2 | 4/2007 | Le et al. | |
| 7,210,716 | B2 | 5/2007 | Mueller et | |
| 7,364,211 | B2 | 4/2008 | Niskanen et al. | |
| 2003/0177974 | A1 | 9/2003 | Dominique | |
| 2004/0031301 | A1 * | 2/2004 | Dominique | 70/237 |
| 2006/0049647 | A1 | 3/2006 | von zur Muehlen | |
| 2007/0069532 | A1 | 3/2007 | Tenorio et al. | |
| 2008/0111381 | A1 | 5/2008 | Merideth et al. | |

* cited by examiner

*Primary Examiner* — Mark Williams

(74) *Attorney, Agent, or Firm* — Dinsmore & Shohl LLP

(57) ABSTRACT

A force adjustment system that inhibits door handle actuation is provided. The force adjustment system includes a sensor configured to provide a signal in response to an input. An energy source is configured to provide an output in response to the signal. A force adjustment component is configured to be linked to a door handle assembly. The force adjustment component comprises a material having a property that is changed in response to the output provided by the energy source to change a force applied to a handle of the door handle assembly.

20 Claims, 7 Drawing Sheets

ADAPTIVE DOOR HANDLES

TECHNICAL FIELD

The present invention generally relates to door handles and, more specifically, to adaptive door handles that provide increased resistance to opening.

BACKGROUND

Door handle assemblies for vehicles may use a return spring to effectuate actuation of both a door handle and an associated latch mechanism. The door handle may be pivotally connected to the door such that an operator can actuate the door handle to open the door.

A door handle spring may be connected to the door handle. The door handle spring may bias the door handle toward its closed position such that when the door handle is released by the operator, the door handle moves from its open to its closed position. The spring bias also inhibits unintended actuation of the door handle.

Because door handles are generally actuated manually, the stiffness of the door handle spring may not be so high as to make manual actuation of the door handle difficult. However, the spring stiffness may be high enough to inhibit unintended actuation of the door handle in certain situations, such as upon a side impact. Thus, it would be desirable to provide a door handle assembly having a resistance to unintended actuations, but yet can be easily opened by the operator.

SUMMARY

In one embodiment, a force adjustment system that inhibits door handle actuation is provided. The force adjustment system includes a sensor configured to provide a signal in response to an input. An energy source is configured to provide an output in response to the signal. A force adjustment component is configured to be linked to a door handle assembly. The force adjustment component comprises a material having a property that is changed in response to the output provided by the energy source to change a force applied to the door handle assembly.

In another embodiment, a door handle assembly includes a door handle having an open position and a closed position. A force adjustment system includes a sensor configured to provide a signal in response to an input. An energy source is configured to provide an output in response to the signal. A force adjustment component includes a material having a property that is changed in response to the output provided by the energy source to change a force applied to the door handle.

In another embodiment, a door includes a door handle assembly having an open position and a closed position. A force adjustment system is connected to the door handle assembly. The force adjustment system includes a sensor configured to provide a signal in response to an input and a force adjustment component comprising a material having a property that is changed to impede movement of the door handle assembly from a closed position to an open position.

These and additional features provided by the embodiments of the present invention will be more fully understood in view of the following detailed description, in conjunction with the drawings.

BRIEF DESCRIPTION OF THE DRAWINGS

The embodiments set forth in the drawings are illustrative and exemplary in nature and not intended to limit the inventions defined by the claims. The following detailed description of the illustrative embodiments can be understood when read in conjunction with the following drawings, where like structure is indicated with like reference numerals and in which:

DETAILED DESCRIPTION

Figure 1:
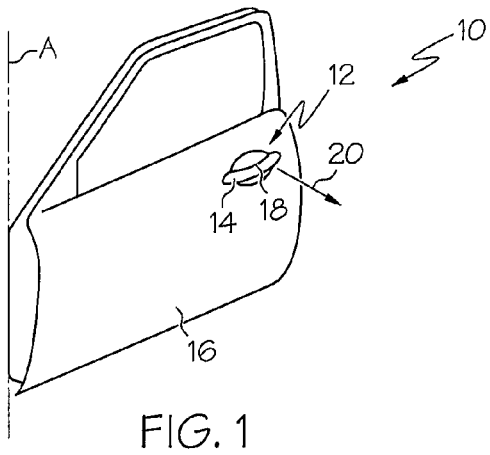
FIG. 1 is a perspective side view of an embodiment of a door for a vehicle.

Referring to FIG. 1, a door 10 of a vehicle is illustrated and includes a door handle assembly 12 including a door handle 14 that is located at an exterior panel 16 of the door. In this embodiment, the door handle 14 is in the shape of a bend or U-shape and can be opened by grasping an intermediate portion 18 of the door handle and pulling in an outward direction away from the door 10 in the direction of arrow 20. Once the door handle is placed in the open position, the door 10 can be opened by pivoting the door about axis A relative to a vehicle frame. In some embodiments, the door handle 14 returns to its closed position once released. While an outward pulling door handle configuration is shown by FIG. 1, other configurations are possible, such as a vertical lifting-type door handle.

Figure 2:
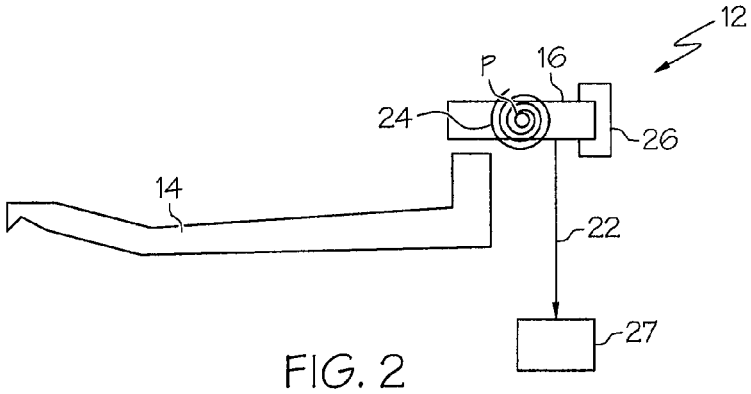
FIG. 2 is a schematic illustrating a top view of an embodiment of a door handle assembly for the door of FIG. 1 in a closed configuration.
Figure 3:
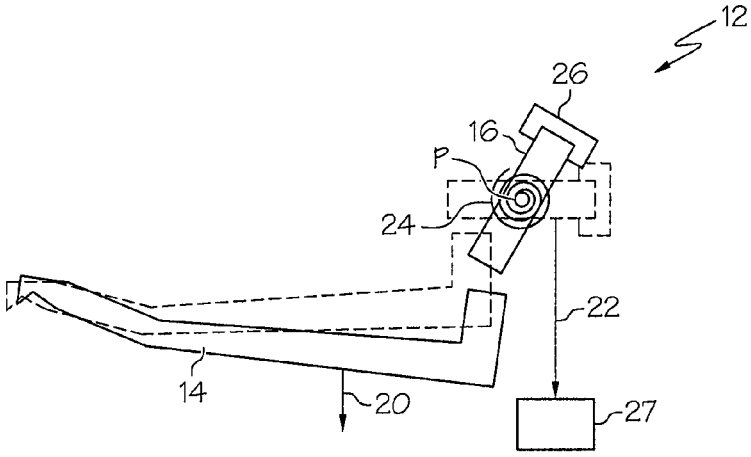
FIG. 3 is a schematic illustrating a top view of the door handle assembly of FIG. 2 in an open configuration.

FIGS. 2 and 3 illustrate the door handle assembly 12 schematically in a closed position (FIG. 2) and an open position (FIG. 3). The door handle assembly 12 includes the door handle 14, which is linked to a latch component 16 (e.g., a bell crank). The physical link between the door handle 14 and the latch component 16 is omitted for clarity, however, the link between the door handle and the latch component can be accomplished by any suitable connection. The latch component 16 can rotate about a pivot P in response to actuation of the door handle 14 in the direction of arrow 20. An actuation member (represented by arrow 22) connects the latch component 16 to a door latch mechanism 27 such that, with the door handle 14 in the closed position (FIG. 2), the door latch mechanism is locked to prevent the door 10 from opening and, with the door handle in the open position (FIG. 3), the door latch mechanism is unlocked to allow the door to open.

As can be seen in FIGS. 2 and 3, the door handle assembly 12 includes a door handle spring 24. The door handle spring 24 may be a torsion-type spring that is connected to the latch component 16 so as to bias the latch component and the door handle 14 toward the closed position due to the linkage between the latch component and the door handle. The door handle spring 24 may obey Hooke's law, which states that the force with which the spring pushes back is linearly proportional to the distance from its equilibrium length:

$$F=-kx,$$

where x is the displacement vector—the distance and direction in which the spring is deformed, F is the resulting force vector—the magnitude and direction of the restoring force the spring exerts, k is the spring constant or force constant of the spring.

Of course, a torsion spring may follow an angular version of Hooke's law where the amount of torque the spring exerts is proportional to the amount the spring is twisted.

In some embodiments, the door handle spring 24 may be pre-loaded when connected to the latch component 16. This can provide a greater biasing force that must be overcome when initially actuating the door 10 than would be provided if the door handle spring 24 were it its equilibrium position. In some embodiments, a counter weight 26 is provided at an end of the latch component 16 opposite the end of the latch component connected to the door handle 14. The counter weight 26 may be used to stabilize the door handle 14 and allow for use of a door handle spring 24 having a lower spring constant so that the door handle assembly 12 can be more easily actuated by an operator to open the door.

Figure 4:
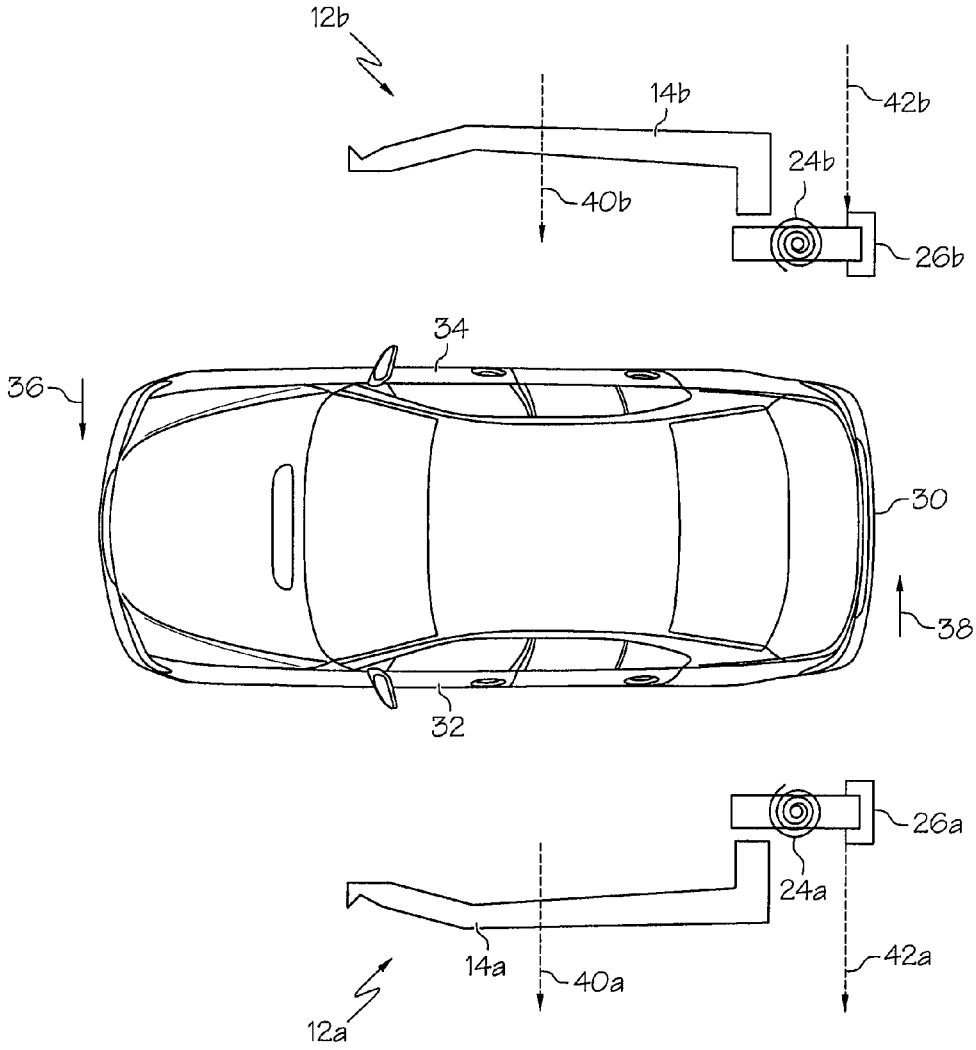
FIG. 4 is a schematic illustrating an embodiment of a vehicle with door handle assemblies.

FIG. 4 schematically illustrates a vehicle 30 with the door handle assembly 12*a* and the door handle assembly 12*b*. The door handle assembly 12*a* is located at a driver's side door 32 of the vehicle for use in opening and closing the driver's side door. The door handle assembly 12*b* is located at a passenger's side door 34 for use in opening and closing the passenger's side door. While the door handle assemblies 12*a* and 12*b* are shown in use with a two-door car, the door handle assemblies may be used with other vehicle types such as those having 4-doors or more, trucks, vans, recreational vehicles, trailers, etc.

For purposes of explanation, a sudden sideways acceleration, such as may be provided as a result of a side impact to the vehicle 30, as represented by arrow 38, tends to generate potential door opening forces due to inertia. For example, a sudden acceleration in the direction of arrow 38 results in an inertial force 40*a* applied to the door handle 14*a*, an inertial force 40*b* applied to door handle 14*b*, an inertial force 42*a* applied to counter weight 26*a* and inertial force 42*b* applied to counter weight 26*b*.

As can be seen by FIG. 4, a sudden acceleration in the direction of arrow 38 results in the inertial force 40*a* that tends toward opening the door handle 14*a*. However, the inertial force 42*a* applied to the counter weight 26*a* along with the spring force of the door handle spring 24 tend to prevent opening of the door handle 14*a* by offsetting the inertial force 40*a*. Thus, in this instance, a heavier counter weight 26*a* may be desirable to inhibit outward movement of the door handle 14*a*. At the passenger's side (the side opposite the side where the acceleration is applied), the inertial force 42*b* applied to the counter weight 26*b* tends toward opening the door handle 14*b*. However, the inertial force 40*b* applied to the door handle 14*b* along with the spring force of the door handle spring 24 tend to prevent opening of the door handle 14*b*. Thus, in this instance, a lighter counter weight 26*b* may be desirable to inhibit outward movement of the door handle 14*b*. However, a sudden acceleration in the direction of arrow 36 may result in opposite inertial forces. Thus, it may also be desirable to provide similar or identical door handle assemblies 12*a* and 12*b*. For both the driver's side and passenger's side door assemblies 12*a* and 12*b*, the door handle spring 24 operates against opening of the door assemblies during acceleration 36 or acceleration 38.

Figure 5:
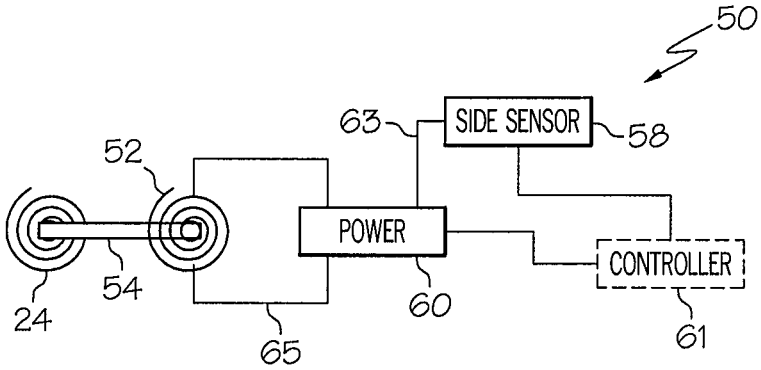
FIG. 5 is a schematic illustrating an embodiment of a spring force adjustment system.

Referring to FIG. 5, a spring force adjustment system 50 is provided that alters the force that the door handle spring 24 applies to the door handle 14 during sudden accelerations, for example, accelerations above a pre-selected threshold acceleration. The spring force adjustment system 50 includes a spring force component 52 that is linked to the door handle spring 24 or to the latch component 16 by a linkage 54. The spring force component 52 may be in the shape of a coil and be formed of a shape memory material. A shape memory material is a material (e.g., an alloy) that remembers its shape, and can be returned to that shape after being deformed, for example, by applying (or removing) a suitable stimuli such as heat to the material. Smart materials may exist in two phases: a martensite phase and an austenite phase. The martensite phase is typically relatively soft and easily deformable. In contrast, the austenite phase is typically stiffer than the martensite phase. When heated, the smart material may transition from the martensite to the austenite phase. Suitable materials may include copper-based and NiTi (nickel and titanium)-based shape memory alloys.

A side sensor 58, such as an accelerometer, a pressure sensor or a combination of sensors, may be used to detect side-to-side accelerations of the vehicle. The side sensor 58 may provide a signal 63 indicating an input, such as a sudden acceleration (e.g., above the threshold acceleration) or side impact to a power source 60, such as a power source for a power lock in the door, or any other suitable power source. The power source 60 may be used to provide an output energy 65 (e.g., resistive heat) or any other suitable activation signal to the spring force component 52 in response to a signal from the side sensor 58. Any suitable resistive heating element may be used. In some embodiments, it may take about 10 milliseconds or less for the spring force adjustment system 50 to respond to a sudden side acceleration. The energy may be removed once the side sensor 58 no longer senses the acceleration above the threshold acceleration. In some embodiments, the side sensor 58 may provide the signal to a controller 61. The controller 61 may control operation of the power source 60 and monitor the signal 63 from the side sensor 58.

Producing the activation signal may include sensing an increased probability of an impact event in the near future, the occurrence of an impact event, manual activation by an occupant or person servicing the vehicle, electronic activation of a built-in logic control system such as activation of a vehicle stability enhancement system (VSES), turning on or off the ignition and the like. Sensing an impact may be accomplished with an impact sensor, pre-impact sensor such as a radar system, vision systems, activation of anti-lock braking systems (ABS) and the like.

The spring force component 52 may have two-way shape memory for remembering two different shapes, for example, one at low temperatures and one at high temperatures. A material that shows a shape memory effect during both heating and cooling may be called a two-way shape memory material. The shape memory material may be trained to learn to behave in a certain way. Under normal circumstances, a shape memory material may remember its high-temperature shape, but upon heating to recover the high-temperature shape, immediately forget the low-temperature shape. However, the shape memory material may be trained to remember to leave some reminders of the deformed low-temperature condition in the high-temperature phases. Any suitable method of training the shape memory material may be utilized.

Suitable shape memory materials may exhibit a one-way shape memory effect or a two-way shape memory effect depending, for example, on the material composition and processing history. In contrast to the two-way shape memory, the one way shape memory materials do not automatically reform and may require an external force to reform the shape orientation that way previously exhibited.

Figure 6:
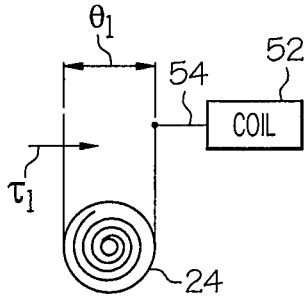
FIGS. 6 and 7 are schematics illustrating operation of an embodiment of a spring force adjustment system.
Figure 7:
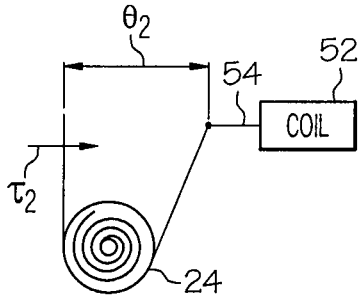

In some embodiments, the spring force component 52, in the form of the coil, contracts (e.g., between about two percent and about 10 percent or more) when energy is applied and returns to its original shape when the energy is removed. Referring to FIGS. 6 and 7, the linkage 54 may be connected to the spring force component 52 such that it is displaced (e.g., rotates, translates, etc.) in response to contraction of the spring force component. The linkage 54 may be relatively rigid and connected to the door handle spring 24 at an end opposite the spring force component 52. Displacement of the linkage 54 may cause the door handle spring 24 to twist, displacing the door handle spring a greater distance from its equilibrium position (e.g., from $\theta_1$ to $\theta_2$), thereby increasing the biasing force (or torque $\tau_1$ to $\tau_2$) applied to the door handle 14.

Figure 8:
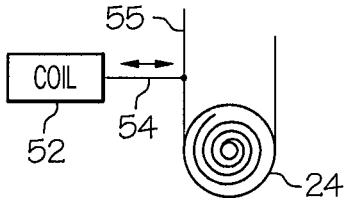
FIG. 8 is a schematic illustrating operation of an embodiment of a spring force adjustment system.

In another embodiment, the spring force component 52 may be used to increase the stiffness of the door handle spring 24, for example, by engaging the door handle spring with the linkage 54 in response to contraction of the spring force component. For example, referring to FIG. 8, the linkage 54 may engage a leg 55 of the door handle spring 24 to resist its movement and resist movement of the door handle assembly 12 toward the open position. In normal operation, the spring force component 52 may allow relatively unimpeded movement of the leg 55. When the spring force component 52 is actuated, the spring force component may provide resistance to movement of the leg 55, which may increase spring stiffness. Such an increase in spring stiffness can increase the bias force on the door handle 14.

Figure 9:
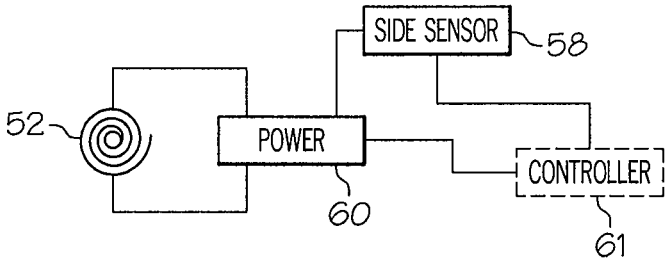
FIG. 9 is a schematic of a spring force adjustment system.

Referring to FIG. 9, the spring force component 52 may, itself, form the door handle spring 24. In the martensite phase, the spring force component 52 in the form of a torsion spring, may have a spring constant that is relatively low, yet is suitable for biasing the door handle 14 toward the closed position under normal operating conditions. When the spring force component 52 is actuated, transitioning to the austenite phase, the spring force component may contract into a smaller shaped spring and the elastic modulus may be higher (e.g., about 70 GPa for NiTi) compared to the elastic modulus of the spring force component in the martensite phase (e.g., about 30 GPa for NiTi). Thus, the spring force component 52 may have a higher spring constant in the austenite phase than in the martensite phase. Such an increase in spring stiffness can increase the bias force on the door handle 14 and maintain the door handle in the closed position.

In some embodiments, it may be desirable to increase the biasing force applied to the door handle 14 by about 10 percent or more, such as about 20 percent or more, such as about 25 percent or more, or such as about 40 percent or more. In certain embodiments, it may be desirable for the biasing force to be at least about 70 Newtons (e.g., between about 70 and about 90 Newtons) with the door handle assembly in its higher torque configuration and the biasing force to be less than about 70 Newtons (e.g., between 30 and about 70 Newtons) with the door handle assembly in its lower torque configuration under normal operating conditions with the door handle 14 in the closed position.

Figure 10:
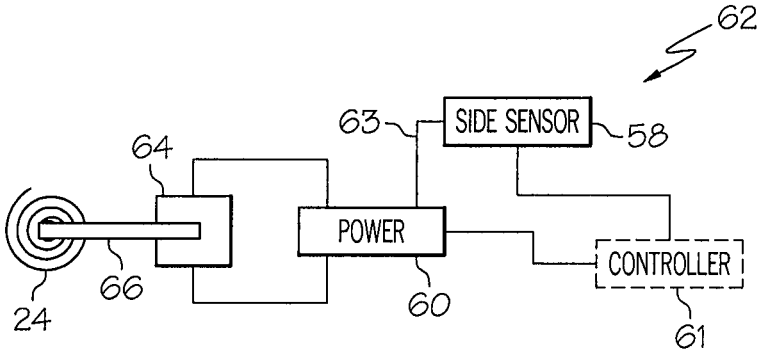
FIG. 10 is a schematic of a spring force adjustment system.
Figure 11:
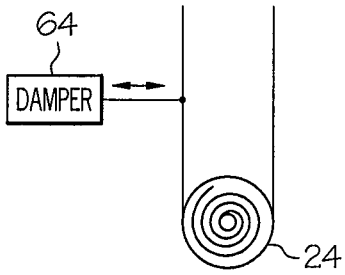
FIG. 11 is a schematic illustrating operation of an embodiment of a spring force adjustment mechanism.

Referring to FIG. 10, another embodiment of a spring force adjustment system 62 includes a damper 64 that may be formed of a smart material. A linkage 66 links the damper 64 and the door handle spring 24. The linkage 66 is linked to the door handle spring 24 (e.g., one of the legs of the door handle spring) such that is movable therewith. The side sensor 58 detects side-to-side accelerations of the vehicle. The side sensor 58 may provide a signal 63 indicating a sudden acceleration to the power source 60. The power source 60 is used to provide an input stimulus (e.g., a magnetic field using an electromagnet) to damper 64 in response to a signal from the side sensor 58. Referring to FIG. 10, under normal operating conditions, the damper 64 is in a relatively low dampening configuration to allow movement of the linkage 66. Once a sudden side acceleration is detected by the side sensor 58, the damper 64 is placed in a relatively high dampening configuration to impede movement of the linkage, which, in turn, impedes actuation of the door handle 14.

Figure 12:
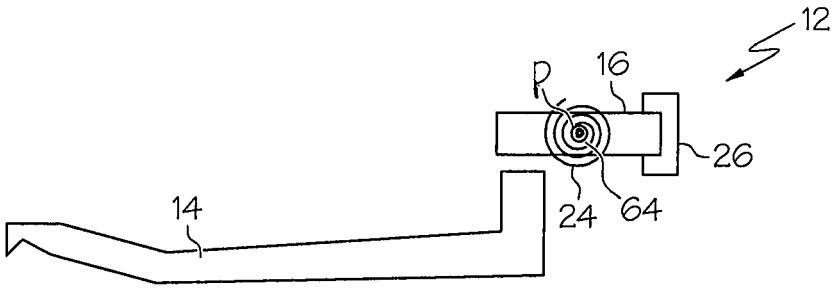
FIG. 12 is a schematic illustrating a top view of an embodiment of a door handle assembly.

In another embodiment, the damper 64 may be used to resist movement of the latch mechanism 16. For example, referring to FIG. 12, the damper 64 may be located at pivot P. Under normal operating conditions, the damper 64 is in a relatively low dampening configuration to allow movement of the latch mechanism 16 about P. Once a sudden side acceleration is detected by the side sensor 58, the damper 64 is placed in a relatively high dampening configuration to impede movement of the latch mechanism 64 about P by providing increased friction, which, in turn, impedes actuation of the door handle 14.

Any suitable material can be used in forming the damper 64. One exemplary material is a magnetorheological fluid (MR fluid). An MR fluid is a suspension of micrometer-sized magnetic particles in a carrier fluid, usually an oil. When subjected to a magnetic field, the MR fluid greatly increases its apparent viscosity, to the point of becoming a viscoelastic solid. The yield stress of the fluid when in its active state can be controlled very accurately by varying the magnetic field intensity. Thus, the MR fluid's ability to transmit force can be controlled with an electromagnet. Other possibilities for forming the damper 64 include shape memory polymers and electro active polymers.

Figure 13:
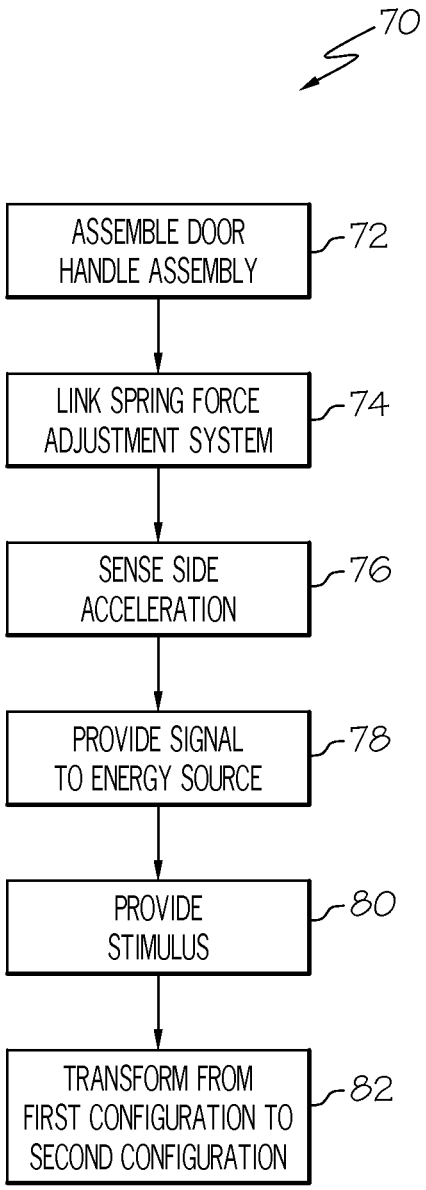
FIG. 13 illustrates an embodiment of a method of inhibiting door opening.

Referring to FIG. 13, a method 70 of inhibiting door opening includes assembling a door handle assembly 12 at step 72. The door handle assembly 12 includes the door handle 14, the latch component 16 and the door handle spring 24 that is used to bias the door handle toward the closed position. The spring force adjustment system 50 is connected or linked to the door handle assembly at step 74. The spring force adjustment system 50 includes a spring force component 52 that is linked to the door handle spring 24 or to the latch component 16 by a linkage 54. The spring force component 52 may be formed of a smart material, such as a shape memory material or a smart material damper, having a first configuration and a second configuration. The spring force component 52 is linked to the door handle assembly 12 such that a greater bias force is applied to the door handle with the spring force component in the second configuration and a lesser bias force is applied to the door handle with the spring force component in the first configuration.

At step 76, the spring force adjustment system 50 may sense a sudden sideways acceleration using the side sensor 58. A signal is sent from the side sensor 58 to the energy source 60 at step 78. The energy source 60 provides a stimulus (e.g., heat, magnetic field, etc.) to the smart material at step 80. The spring force component 52 transforms from the first configuration associated with a low spring bias force to the second configuration associated with a high spring bias force at step 82.

Figure 14:
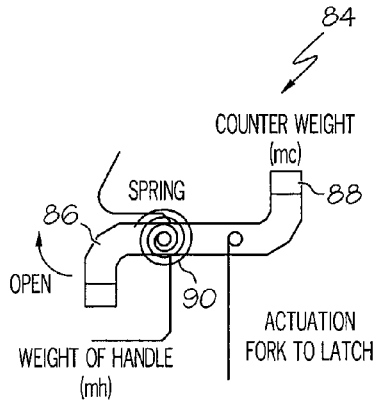
FIG. 14 is a schematic illustrating an embodiment of a door handle assembly in the closed configuration.
Figure 15:
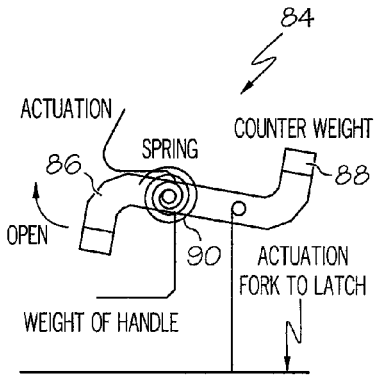
FIG. 15 is a schematic illustrating the door handle assembly of FIG. 14 in the open configuration.
Figure 16:
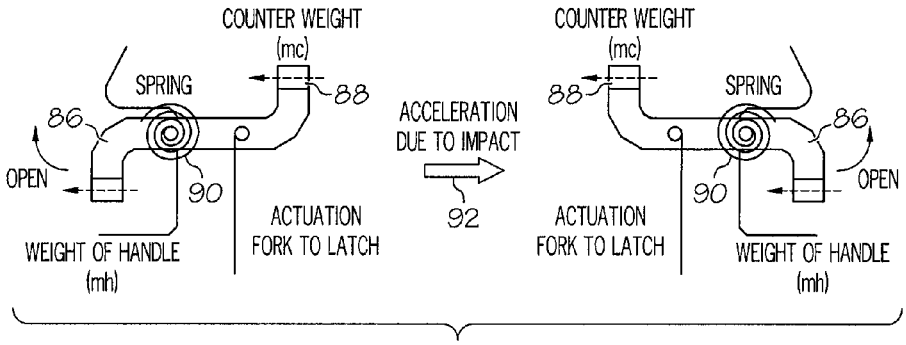
FIG. 16 is a schematic illustrating inertia forces due to acceleration on the door handle assembly of FIG. 14.

While particular embodiments and aspects of the present invention have been illustrated and described herein, various other changes and modifications can be made without departing from the spirit and scope of the invention. For example, FIGS. 14 and 15 illustrate another door handle assembly 84 that is actuated by lifting vertically on a door handle 86. The door handle assembly 82 includes a counter weight 88 and a door handle spring 90 for biasing the door handle assembly to its closed configuration. FIG. 14 illustrates the door handle assembly in the closed configuration and FIG. 15 illustrates the door handle assembly in the open configuration. FIG. 16 illustrate forces created due to a sudden side acceleration in the direction of arrow 92. The spring force adjustment systems 50 and 62 may be used to increase the bias force applied to the door handle during such sudden accelerations to reduce the possibility of unintended door opening, yet provide for easy actuation and opening of the door handle assembly under normal operating conditions. Moreover, although various inventive aspects have been described herein, such aspects need not be utilized in combination. It is therefore intended that the appended claims cover all such changes and modifications that are within the scope of this invention.

What is claimed is:

1. A force adjustment system that inhibits door handle actuation, the force adjustment system comprising:

a sensor that detects vehicle acceleration and provides a signal in response to the vehicle acceleration;

an energy source that provides an output in response to the signal; and a force adjustment component linked to a door handle assembly, the force adjustment component comprising a material having a property that is changed in response to the output provided by the energy source to change a force applied to the door handle assembly to maintain the door handle assembly in a closed configuration, wherein the force adjustment component has a first configuration and a second configuration, wherein the force adjustment component transitions from the first configuration to the second configuration in response to the output provided by the energy source, and wherein the force adjustment component inhibits door handle actuation in the second configuration.

2. The force adjustment system of claim 1, wherein the force adjustment component comprises a shape memory alloy.

3. The force adjustment system of claim 2, wherein the force adjustment component comprises a coil comprising the shape memory alloy.

4. The force adjustment system of claim 3, wherein the coil is in an expanded state in the first configuration and in a contracted state in the second configuration, wherein the coil increases a bias force against the door handle assembly in the second configuration.

5. The force adjustment system of claim 3 further comprising a linkage that links the coil to the door handle assembly.

6. The force adjustment system of claim 5, wherein the linkage moves as the coil transitions from the first configuration to the second configuration.

7. The force adjustment system of claim 1, wherein the force adjustment component comprises a smart material damper.

8. The force adjustment system of claim 7 further comprising a linkage that links the smart material damper to the door handle assembly.

9. The force adjustment system of claim 8, wherein the smart material damper inhibits movement of the linkage with the smart material damper in the second configuration to a degree greater than the smart material damper inhibits movement of the linkage with the smart material damper in the first configuration.

10. A door handle assembly, comprising:

a door handle having an open position and a closed position; and a force adjustment system comprising:

a sensor that detects vehicle acceleration and provides a signal in response to the vehicle acceleration;

an energy source that provides an output in response to the signal; and a force adjustment component linked to the door handle, the force adjustment component comprising a material having a property that is changed in response to the output provided by the energy source to change a force applied to the door handle to maintain the door handle in the closed position, wherein the force adjustment component has a first configuration and a second configuration, wherein the force adjustment component transitions from the first configuration to the second configuration in response to the output provided by the energy source, and wherein the force adjustment component inhibits door handle actuation in the second configuration.

11. The door handle assembly of claim 10 further comprising a door handle spring that provides a bias force that biases the door handle toward the closed position, the force adjustment component increasing the bias force applied by the door handle spring with the door handle in the closed position.

12. The door handle assembly of claim 10, wherein the force adjustment component comprises a shape memory alloy, wherein the transition of the shape memory alloy from the first configuration to the second configuration increases the force applied to the door handle with the door handle in the closed position.

13. The door handle assembly of claim 12, wherein the force adjustment component comprises a coil comprising the shape memory alloy, the coil being in an expanded state in the first configuration and in a compacted state in the second configuration.

14. The door handle assembly of claim 13, wherein the force adjustment component is a door handle spring that biases the door handle toward the closed position, the force adjustment component having a martensite phase providing a relatively low spring stiffness and an austenite phase providing a relatively high spring stiffness.

15. The door handle assembly of claim 13 further comprising a linkage that links the coil to the door handle spring, the linkage connected to the door handle spring and the coil such that the linkage increases a stiffness of the door handle spring when the coil transitions from the first configuration to the second configuration.

16. The door handle assembly of claim 10, wherein the force adjustment component comprises a smart material damper.

17. The door handle assembly of claim 16, wherein the smart material damper inhibits movement of the door handle with the smart material damper in the second configuration to a degree greater than the smart material damper inhibits movement of the door handle with the smart material damper in the first configuration.

18. A door, comprising:

a door handle assembly having an open position and a closed position; and a force adjustment system connected to the door handle assembly, the force adjustment system comprising:

a sensor that detects vehicle acceleration and provides a signal in response to the vehicle acceleration;

an energy source that provides an output in response to the signal; and a force adjustment component linked to the door handle assembly, the force adjustment component comprising a material having a property that is changed in response to the output provided by the energy source to impede movement of the door handle assembly from a closed position to an open position, wherein the force adjustment component has a first configuration and a second configuration, wherein the force adjustment component transitions from the first configuration to the second configuration in response to the output provided by the energy source, and wherein the force adjustment component impede movements of the door handle assembly from the closed position to the open position in the second configuration.

19. The door of claim 18, wherein the force adjustment mechanism is a spring comprising the material, the material being a memory shape material having a martensite and an austenite phase.

20. The door of claim 18, wherein the force adjustment component comprises a smart material damper.

* * * * *